US008784223B2

(12) United States Patent
Talafous

(10) Patent No.: US 8,784,223 B2
(45) Date of Patent: Jul. 22, 2014

(54) SKATING TRAINING SYSTEM

(76) Inventor: Dean C. Talafous, Hudson, WI (US)

( * ) Notice: Subject to any disclaimer, the term of this patent is extended or adjusted under 35 U.S.C. 154(b) by 2011 days.

(21) Appl. No.: 10/912,205

(22) Filed: Aug. 4, 2004

(65) Prior Publication Data

US 2005/0124425 A1 Jun. 9, 2005

Related U.S. Application Data

(60) Provisional application No. 60/517,118, filed on Nov. 3, 2003.

(51) Int. Cl.
*A63C 19/10* (2006.01)
*A63B 69/00* (2006.01)
*A63G 21/00* (2006.01)

(52) U.S. Cl.
CPC ..... *A63B 69/0022* (2013.01); *A63B 69/0026* (2013.01); *A63C 19/10* (2013.01); *A63G 21/00* (2013.01)
USPC ..... 472/90; 434/253

(58) Field of Classification Search
USPC ..... 472/88–92; 482/14, 15, 19; 434/247, 434/255
See application file for complete search history.

(56) References Cited

U.S. PATENT DOCUMENTS

| | | | | |
|---|---|---|---|---|
| 2,469,021 | A | | 5/1947 | Vetter |
| 3,497,211 | A | | 2/1970 | Nagin |
| 3,508,945 | A | | 4/1970 | Haemer et al. |
| 3,726,817 | A | | 4/1973 | Niswonger |
| 4,169,688 | A | | 10/1979 | Toshio |
| 5,076,571 | A | | 12/1991 | Croce, Jr. et al. |
| 5,385,520 | A | | 1/1995 | Lepine et al. |
| 5,524,310 | A | * | 6/1996 | Farnen ..... 14/69.5 |
| 5,837,343 | A | | 11/1998 | Park et al. |
| 5,897,457 | A | * | 4/1999 | Mackovjak ..... 482/8 |
| 5,904,021 | A | | 5/1999 | Fisher |
| 6,059,673 | A | | 5/2000 | Mason |
| 6,061,979 | A | | 5/2000 | Johannes |

(Continued)

FOREIGN PATENT DOCUMENTS

| | | |
|---|---|---|
| FR | 2811233 A | 1/2002 |
| WO | 9208936 | 5/1992 |
| WO | WO9208936 | 5/1992 |
| WO | WO9807481 | 2/1998 |

OTHER PUBLICATIONS

Viking Ice; "Viking Ice: Synthetic Indoor Ice Rinks;" http://www.vikingice.com/icespecs.asp; Viking Ice, LLC; Portland, OR; date unknown.

(Continued)

*Primary Examiner* — Kien Nguyen
(74) *Attorney, Agent, or Firm* — Dicke, Billig & Czaja, PLLC

(57) ABSTRACT

A system and method for improving skating speed and strength of skaters, particularly ice skaters, employs an inclined skating ramp. The skating surface itself may be any of the conventional or yet-to-be-invented artificial ice surfaces. The inclination of the ramp provides a greater challenge for the skating student than a conventional flat skating surface. While the inclined ramp may have more than one lane, so that more than one student may skate side-by-side in competition with each other, it is preferred to have only a single lane and employ a timing system so that a student is skating "against the clock" and therefore focused on improvement of individual performance.

32 Claims, 1 Drawing Sheet

(56) References Cited

U.S. PATENT DOCUMENTS

| | | | | |
|---|---|---|---|---|
| 6,139,438 | A | 10/2000 | Park et al. | |
| 6,155,957 | A * | 12/2000 | Worley et al. | 482/8 |
| 6,181,647 | B1 * | 1/2001 | Tipton et al. | 368/10 |
| 6,227,759 | B1 | 5/2001 | Fricke | |
| 6,676,529 | B2 * | 1/2004 | Pernal | 472/89 |
| 6,866,589 | B1 * | 3/2005 | Widrick et al. | 472/90 |

OTHER PUBLICATIONS

Kwik Rink; "Technical Information;" http://www.kwikrink.com/technical.html; KwikRink; Maple Grove, MN; unknown.

Sportcourt; "Gymn Sports Flooring: Guide Specifications for SportCourt® Response 6.0 Flooring;" http://www.sportcourtoflowa.com/specs.htm; Sport Court of Iowa; Clive, IA; unkown.

Rink Systems; "Flooring and Sports Systems;" http://www.rinksystems.com/flooring&sport_surfaces.html; Rink Systems, Inc.; Albert Lea, MN; unkown.

Brower Timing Systems; "Brower Timing Systems: Product Specifications: CML5MEM;" http://www.browertiming.com/sp_nwspecs.htm; Brower Timing Systems; Draper, UT; unknown.

Canadian Office Action; mailed Apr. 4, 2011.

Canadian Office Action, mailed Apr. 12, 2012, in CA2476740.

* cited by examiner

SKATING TRAINING SYSTEM

CROSS-REFERENCE TO RELATED APPLICATION

This application claims the benefit of U.S. provisional patent application No. 60/517,118 filed Nov. 3, 2003.

FIELD OF THE INVENTION

This invention concerns systems and methods for teaching skating, especially the skating performed in the game of hockey.

BACKGROUND OF THE INVENTION

The most important aspect of skating skill in ice hockey is the ability to rapidly "get up to speed," i.e., achieve the fastest possible speed in the shortest possible time from a starting position. An ice hockey player needs to be up to full skating speed within only a relatively small number of steps, about three to five at the most. Skaters in other sports, such as figure or speed skating, or roller hockey, also need this ability.

Because skating speed is determined largely by leg strength (and, to a lesser extent, overall skating technique), resistance exercises (e.g., weight training) are a suitable approach to improving skating speed. However, as in most sports other than weight lifting itself, weight training cannot completely substitute for exercising the actual skating motion itself, nor can it provide adequate practice of the other aspects of skating form (such as arm motion, balance, and the ability to control and shift weight from one leg to the other). Similarly, simply adding additional weight to skaters, especially young skaters, may counterproductive and inefficient in the overall development of skating speed and skill.

SUMMARY OF THE INVENTION

The invention is a system and method for improving skating speed, strength, and technique, especially for ice hockey players but also for roller hockey skaters and all other ice skaters. The invention employs an inclined ramp, as opposed to the conventional flat rink. The inclined ramp is constructed to have an artificial ice skating surface supported by an inclined frame. The skating surface may be any of the conventional or yet-to-be-invented artificial ice surfaces, or a surface appropriate for roller hockey or rollerblading.

BRIEF DESCRIPTION OF THE DRAWINGS

The accompanying drawings show a particular embodiment of the invention as an example, and are not intended to limit the scope of the invention.

FIGS. 1-2 are schematic views from various angles of a particular embodiment of the invention.

FIG. 1 is a perspective view of an embodiment of the invention.

FIG. 2 is a cross section taken along the line A-A of FIG. 1.

DETAILED DESCRIPTION

Figure 1:
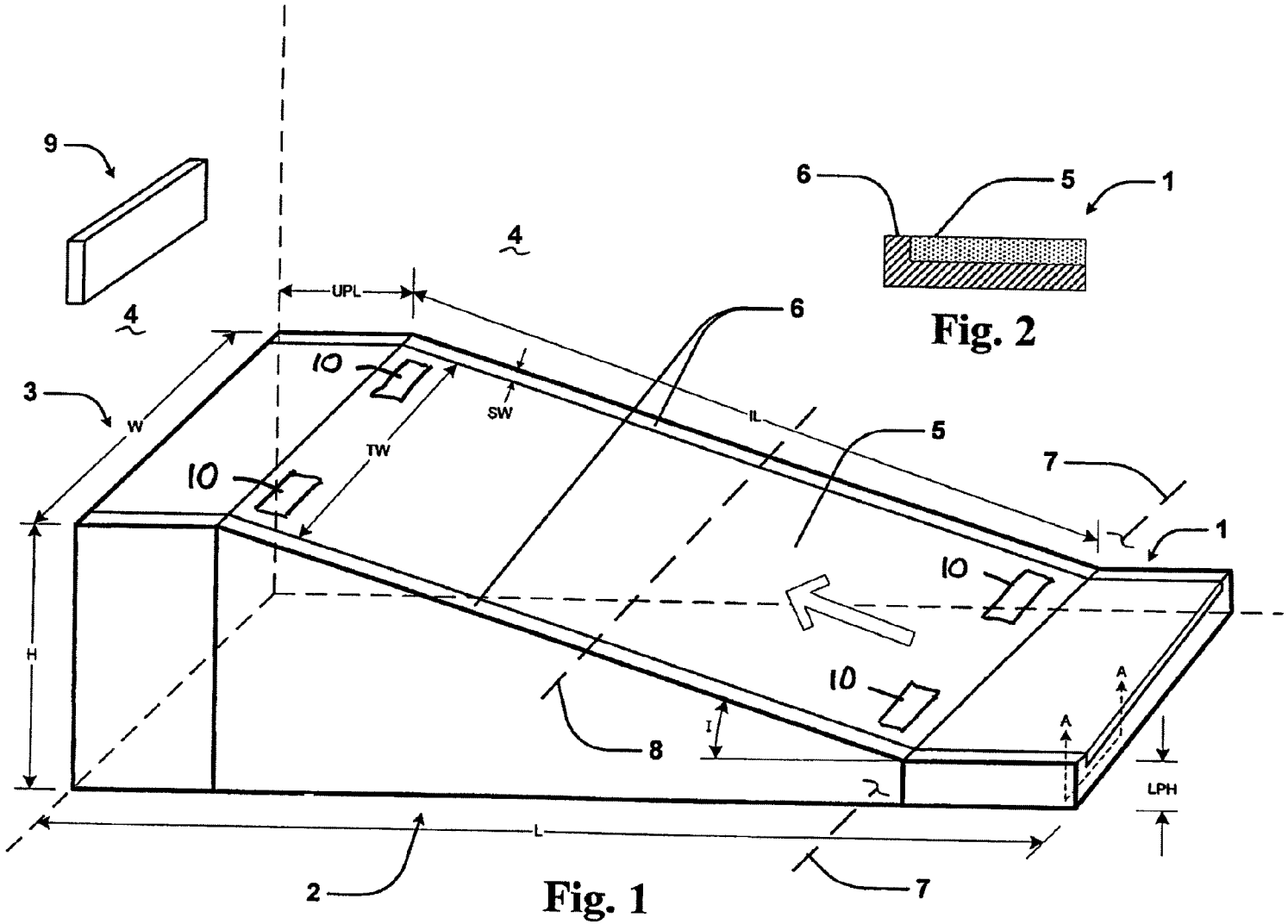

FIG. 1 is a perspective view of an embodiment of the invention. There are several main sections to the invention, some of which are optional but so highly desired that they are shown in FIG. 1 in the same manner as the required components.

An optional lower platform 1, and an optional but highly desired upper platform 3 are located at opposite ends of a required inclined ramp 2. A skater (not shown) stands on the lower platform 1 (if present) or at the bottom of the inclined ramp. The skater, either on seeing or hearing an appropriate "Go!" signal or simply on the skater's own initiative, skates up the inclined ramp 2 toward the upper platform 3, as indicated by the arrow in the middle of the inclined ramp included in FIG. 1.

As illustrated in FIG. 1, the "up" direction of the inclined ramp is in the same direction as the skater's path. This distinguishes the invention from systems in which there is an inclined wedge or other piece lying to the side of the skater so that the skater encounters additional resistance when pushing off their skates to each side.

The added resistance of the inclined ramp, as opposed to what the skater experiences when skating the same distance on a conventional horizontal rink surface, requires that the skater work harder to skate the same distance. The additional effort is particularly required during the critical first few strides of the skater, so that the skater develops sufficient speed to enable them to coast or otherwise stride to the top of the ramp and not slide back down again.

Thus, the invention provides several advantageous benefits that cannot be achieved by simply adding additional weight to the skater on a conventional horizontal rink. First, the additional resistance provided by the inclined ramp is present only during the critical first strides and not during the entire time that the skater carries the additional weight. Second, the invention provides a means of assessment, in actual performance, of the effectiveness of other training techniques, because the invention provides a measurable type of performance that is very sensitive to the skater's development of improved speed and quickness. Such assessment is quicker and faster than other assessment techniques. Third, the inclined skating path reduces or eliminates the potential for skaters to coast on flat surfaces. Instead, the inclined path requires them to skate harder yet does not require a change in the mechanics of the skater's hip flexor and abductor muscles.

The angle of incline of the ramp (indicated as I in FIG. 1) may be any value greater than zero degrees. The preferred angle is approximately five degrees, which represents an elevation of approximately one inch for each one foot of inclined skating distance. Angles of incline of approximately eight degrees or greater are detrimental to the skater's performance because they typically require that the skater modify their stride. One of the great advantages of the invention is that it adds resistance to the skater without requiring a change in normal skating stride.

The approximate dimensions indicated below with reference to FIG. 1 are preferred, but not required provided that the overall definition of the invention is met.

| Dimension (FIG. 1) | Value |
|---|---|
| Overall Length (L) | 62 feet |
| Overall Height (H) | 42 inches |
| Overall Width (W) | 10 feet |
| Track Width (TW) | 8 feet |
| Sideline Width (SW) | 1 foot |
| Upper Platform Length (UPL) | 16 feet |
| Incline Length (IL) | 40 feet |
| Lower Platform Length (LPL) | 6 feet |
| Lower Platform Height (LPH) | 3½ inches |

The upper landing is desirable because it provides adequate space for skaters to return to the floor at the end of their exercise, by going down stairs (not shown) that may be attached at either side or the back of the upper platform. The preferred location for stairs is the side of the upper platform and/or inclined ramp, with the stairs arranged so that going down the stairs points the skater back to the lower platform. That arrangement reduces the overall footprint of the invention within the training facility, and encourages the skater to return for another session up the ramp so that they can attempt to better their performance. This arrangement of the stairs also frees up the other side of the invention and the back end of the upper platform so that those locations may be used to attach the invention to the building, as described below.

For ice skating training, the surface 5 of the inclined ramp 2 may be any of the known or yet-to-be-invented artificial ice materials that are compatible with normal ice skates and thus commonly used in indoor hockey training facilities without actual ice sheets. Suitable artificial ice surfaces include those commercially available as "Viking Ice" from Viking Ice, LLC of Portland, Oreg., USA; "Kwik Rink Commercial Synthetic Ice" and "Kwik Rink Original Synthetic Ice" from KwikRink Synthetic Ice, LLC of Maple Grove, Minn., USA. The preferred surface is the "Kwik Rink Commercial Synthetic Ice" product (¾ inch thickness). The surface should be installed according to the manufacturer's directions but no special treatment is necessary to accommodate installation on the inclined surface.

Other possible surfaces are those disclosed in the following U.S. patents: U.S. Pat. No. 2,469,021 (Vetter); U.S. Pat. No. 3,497,211 (Nagin); U.S. Pat. No. 3,508,945 (Haemer et al.); U.S. Pat. No. 3,726,817 (Niswonger); U.S. Pat. No. 4,169,688 (Toshio); U.S. Pat. No. 5,076,571 (Croce, Jr. et al.); U.S. Pat. No. 5,835,520 (Lepine et al.); U.S. Pat. No. 5,837,343 (Park et al.); U.S. Pat. No. 6,059,673 (Mason); U.S. Pat. No. 6,139,438 (Park et al.); U.S. Pat. No. 6,227,759 (Fricke et al.).

For roller hockey training, the surface 5 of the inclined ramp 2 may be any of the known or yet-to-be-invented materials that are compatible with normal rollerblades and thus commonly used in indoor or outdoor roller hockey training facilities. Suitable surfaces include those commercially available as "Sport Court" from Sport Court International, Inc. of Salt Lake City, Utah, USA (which comprises one square foot tiles of what is believed to be a polypropylene copolymer material); "Flight Deck"; or "Ice Court" (advertised as reinforced polypropylene having ultra-violet and oxidation protection). The preferred surface is the "Sport Court" product. The surface should be installed according to the manufacturer's directions taking into account installation on the inclined surface.

Other possible surfaces are those disclosed in the following U.S. patents: U.S. Pat. No. 5,904,021 (Fisher); and U.S. Pat. No. 6,061,979 (Johannes), the later believed to be commercialized as the "Ice Court" product mentioned above.

The construction of the inclined ramp, upper and lower platforms (if the latter is used), and stairs, all generally include a sturdy (preferably permanent) frame of material such as conventional framing lumber (e.g., 2×4, 2×6, 2×8, 2×10, 2×12 and similar sizes) and conventional framing techniques that are not critical to the scope of the invention. The invention may also be constructed in whole or in part with metal, plastic, and other materials suitable for structural construction, using techniques appropriate to the choice of materials.

In principle it is possible to embody the invention in a "portable" or movable form that can be temporarily used in different locations. This may involve conventional wheels, casters, brakes, and the like if desired, all according to known principles. However, as suggested above, it is very desirable to bolt or otherwise permanently attach the invention to one of more of the walls 4 of a training facility. Such permanent attachment includes constructing the building itself so that the invention is a natural extension of the building frame. Permanent attachment is best accomplished with the invention oriented so that a wall lies along either one side of the inclined ramp (i.e., the side not shown in FIG. 1), or the back of the upper landing, or both (i.e., the invention is located in a corner of the building). In addition to reducing the need for railings on one or more sides (discussed below), this arrangement provides additional stability and therefore minimizes wobbling as skaters move up the ramp. It may also be required by local building codes, which of course should be followed.

Generally, the width of the actual skating surface 5 is conveniently chosen as eight feet because commercially available materials, such as commercially available artificial ice materials, are available in sheets measuring four feet by eight feet. However, a custom-sized surface is within the scope of the invention. Similarly, it is possible but not required to construct the inclined surface so that one or more adjacent non-skating "sideline" regions 6 is included on a side of the skating surface. One advantage of such a region is that it provides a space between the skating surface and the edge of the ramp, which provides an additional margin of safety to keep a fallen skater from falling off the ramp to the floor below. In particular, the framing of the inclined surface may be designed to hold the material of the skating surface within the frame so that it is flush with any surrounding region, to avoid seams and other minor ridges that that a skater could trip on, as illustrated in FIG. 2.

An alternative or addition to sideline regions, which may be required by local codes in any event, is to construct a low railing on the outside face of the inclined ramp so that the skating surface may extend to substantially the side edge of the inclined ramp with little or no sideline region 6. For example, railings of approximately 34 to 42 inches in height are acceptable for this purpose. Other railings (not shown) may be dictated by local building codes and other safety considerations. For example, the stairs, wherever they may be located with respect to the inclined ramp and upper platform, will likely be required to have railings and/or handrails to comply with local building codes. Similarly, the inclined ramp itself may be required to have a railing on one or more sides to prevent a fall from the ramp at a given height above the floor (such as approximately 30 inches).

The dimensions of the stairs themselves, such as their width and step height, will be determined in a similar manner. It may be desirable to change such dimensions to accommodate the skates worn by those using the steps, provided that local codes are not violated. All such modifications are not critical to the broadest scope of the invention.

It is preferred to include a system to time the performance of skaters within a fixed region lying within the full extent of the inclined ramp. This timing system is easily provided by equipment which begins the timing interval when the skater crosses a beam 7 at or very near the lowest location on the ramp and then crosses another beam 8 at an upper location to stop the clock. The height of each beam above the skating surface is not critical to the scope of the invention.

This type of equipment is commonly used for similar purposes in the sports of skiing, snowboarding, running, various types of motor sports racing, and rodeo. The preferred arrangement is for the timed portion of the inclined ramp to begin at the beginning of the ramp, and end after approximately twenty feet, leaving an additional distance (as shown, another twenty feet) for skaters to continue coasting to a slower speed as they proceed up the remainder of the inclined ramp before reaching the upper platform. This helps ensure that the skater has time to enjoy their performance against themselves, and also to slow down to a safe speed for disembarking from the inclined ramp onto the upper platform.

It is particularly preferred for the time to be displayed above the upper platform by a display 9, so that skaters may see their performance and enjoy their achievement immediately upon crossing through the upper beam. This immediate feedback enhances the training value of the invention. To provide the timing circuitry, suitable equipment is a pair of model RD-175 wireless transmitters and a model CML5MEN display as provided by Brower Timing Systems, LLC of Draper, Utah, USA, or their equivalent.

It is also possible, but not required, to employ various systems in which sensors 10 are located in the skater's equipment (such as inside the skates) and/or mounted underneath the artificial ice surface, so that various parameters such as the speed and trajectory and force associated with individual skating steps may be measured and correlated with the skater's time or other measures of the skater's performance. It is also possible to provide a videotape or similar audiovisual recording and playback system so that the performance, biomechanics, and the like of skaters is recorded and coordinated with their times.

Of course, other equivalent measures of performance may be included or substituted for a time measurement, with appropriate modifications made to the measurement apparatus (e.g., additional beams not shown in FIG. 1 may be required). Such measures include beginning, ending, maximum, minimum, and average speed; beginning, ending, maximum, minimum, and average acceleration; a simple comparison to either a baseline value or the skater's own previous (or personal best) value, but without focusing on numerical values so that students will not obsess over their "number" but instead have fun and concentrate on improving technique (e.g., a green light means improvement but a numeric value is not shown); and so on.

It is optional but desirable to provide the skating surface material with both the upper and lower platforms so that skaters begin and end their session on the inclined ramp on the same surface. However, this is not strictly required and may in fact be undesirable because of the relatively high cost of the artificial ice surfaces (approximately US $16/square foot).

Building codes may require that all wood used to construct the invention be fire rated or similarly treated lumber. Of course, the invention does not require wood as the framing material, and thus other non-combustible materials could be employed. For example, all or part of the frame could be conventionally assembled plastic lumber, plastic or metal pipe, and the like, provided that the artificial skating surface is presented to the skater in the same manner as described above, and that all applicable building codes and other structural strength issues are adequately addressed.

While the inclined ramp may have more than one lane, so that more than one student may skate side-by-side in competition with each other, it is preferred to have only a single lane and employ the timing system described above so that a student is skating "against the clock" and therefore focused on improvement of individual performance. This has been found to be a better training technique than pitting students, especially young students, against each other in direct competition. However, the invention includes multiple parallel lanes constructed according to the general principles above.

Variations on the invention schematically illustrated in the figures are within the level of skill in the art. For example, the construction described above generally involves conventional framing lumber and framing skills, and therefore a person skilled in the art of framing construction could build an embodiment of the invention in an different manner yet still be within the scope of the following claims.

I claim:

1. An inclined skating ramp, comprising an artificial ice skating surface securely supported by an inclined frame, used to improve the speed and quickness of a skater.

2. The ramp of claim 1, in which the skating surface is an artificial ice skating surface.

3. The ramp of claim 1, in which the skating surface is a roller skating surface.

4. The ramp of claim 1, in which skating surface is supported by the inclined frame at an angle of incline not more than eight degrees.

5. The ramp of claim 1, in which the inclined ramp has an upper end and a lower end, and the system further comprises a lower platform at the lower end of the inclined ramp.

6. The ramp of claim 5, in which the lower platform further comprises a skating surface.

7. The ramp of claim 1, in which the inclined ramp has an upper end and a lower end, and the system further comprises an upper platform at the upper end of the inclined ramp.

8. The ramp of claim 7, in which the upper platform further comprises a skating surface.

9. The ramp of claim 1, in which the inclined frame is constructed from one of wood, metal, and plastic.

10. The ramp of claim 1, in which the skating surface has a width of approximately eight feet.

11. The ramp of claim 1, in which the skating surface has a length of approximately forty feet.

12. The ramp of claim 1, further comprising at least one sideline region adjacent the skating surface.

13. The ramp of claim 12, in which the skating surface is supported by the inclined frame to be flush with the sideline region.

14. The ramp of claim 1, further comprising a railing on an outside face of the inclined ramp.

15. The ramp of claim 1, in which there is a single lane of skating surface.

16. The ramp of claim 1, in which there are multiple lanes of skating surface.

17. The ramp of claim 1, in which the ramp is permanently affixed to a building.

18. The ramp of claim 1, in which the ramp is portable.

19. The inclined skating ramp of claim 1, and further comprising at least one sensor attached thereto.

20. A system for improving skating skills, comprising an inclined ramp having an artificial ice skating surface securely supported by an inclined frame.

21. The system of claim 20, further comprising a performance measurement system to measure performance of a skater within a measurement region of the skating surface.

22. The system of claim 21, in which the performance measurement system begins measurement of skater performance when the skater crosses a first beam and ends measurement of skater performance when the skater crosses a second beam.

23. The system of claim 21, in which the measurement region extends for approximately twenty feet of the skating surface.

24. The system of claim 21, further comprising a display located above the inclined ramp to display measured performance.

25. The system of claim 21, in which the performance measurement system measures one of elapsed time, beginning speed, ending speed, maximum speed, minimum speed, average speed, beginning acceleration, ending acceleration, maximum acceleration, minimum acceleration, average acceleration, comparison to a baseline value, comparison to a previous value, and comparison to a personal best value.

26. The system of claim 20, further comprising sensors in a skater's equipment or mounted underneath the skating surface.

27. The system of claim 26, in which the sensors measure one of speed, trajectory, and force associated with individual skating steps.

28. The system of claim 20, further comprising an audio-visual recording system to record performance or biomechanics of a skater.

29. A method of improving skating speed, comprising skating up an artificial ice skating surface securely supported by an inclined frame.

30. The method of claim 29, and further comprising measuring skating speed using at least one sensor in a skater's equipment or mounted underneath the skating surface.

31. A method of teaching improved skating speed, comprising the use of an inclined skating ramp constructed of an artificial ice skating surface securely supported by an inclined frame, to improve the ability of a skater to achieve their fastest possible speed in the shortest possible time from a starting position.

32. The method of claim 31, and further comprising measuring skating speed using at least one sensor in a skater's equipment or mounted underneath the skating surface.

* * * * *